US005871818A

United States Patent [19]

Button et al.

[11] Patent Number: 5,871,818

[45] Date of Patent: Feb. 16, 1999

[54] THICK FILM COATING PROCESS

[75] Inventors: Timothy William Button; Geoffrey Dolman, both of Solihull; Carl Meggs, Redditch; Paul Anthony Smith, Bromsgrove, all of England

[73] Assignee: Illinois Superconductor Corporation, Mt. Prospect, Ill.

[21] Appl. No.: 908,294

[22] Filed: Aug. 7, 1997

Related U.S. Application Data

[63] Continuation of Ser. No. 551,372, Nov. 1, 1995, abandoned.

[51] Int. Cl.[6] ..... B05D 3/12

[52] U.S. Cl. ..... 427/356; 118/107

[58] Field of Search ..... 118/107; 427/356

[56] References Cited

U.S. PATENT DOCUMENTS

| | | | |
|---|---|---|---|
| 21,192 | 8/1858 | Gardner | 118/107 |
| 31,913 | 4/1861 | Sperry et al. | 118/107 |
| 43,189 | 6/1864 | Ferguson | 118/107 |
| 53,338 | 3/1866 | Reinauer | 118/107 |
| 90,658 | 6/1869 | Garrison | 118/107 |
| 3,691,992 | 9/1972 | Beemer | 118/107 |
| 3,955,531 | 5/1976 | Brown | 118/261 |
| 4,256,051 | 3/1981 | Landsness | 118/107 |
| 4,372,796 | 2/1983 | Greuel, Jr. | 156/187 |
| 4,394,408 | 7/1983 | Walter et al. | 427/231 |
| 4,425,866 | 1/1984 | Hoffman | 118/58 |
| 4,460,422 | 7/1984 | Michael | 156/175 |
| 4,642,248 | 2/1987 | Howland | 427/224 |
| 4,875,434 | 10/1989 | Maejima et al. | 118/52 |
| 4,895,098 | 1/1990 | Akagawa et al. | 118/56 |
| 5,284,229 | 2/1994 | Logan et al. | 118/107 |

*Primary Examiner*—Katherine A. Bareford

*Attorney, Agent, or Firm*—Marshall, O'Toole, Gerstein, Murray & Borun

[57] ABSTRACT

A coating device for use in coating circular cross-sectioned substrates has a semi-circular doctor blade. The coater may also have a plate for holding axially symmetric substrates which can be rotated about an axis. A groove in the plate centers the substrate on the plate for rotation. The doctor blade is located adjacent to the substrate such that when the plate and substrate are rotated, the doctor blade applies a uniform thickness of coating to one side of the substrate. After one side of the substrate has been coated, the other side is coated by placing the substrate coated side down on a plate with a larger groove to accommodate the increased size of the substrate due to coating.

9 Claims, 5 Drawing Sheets

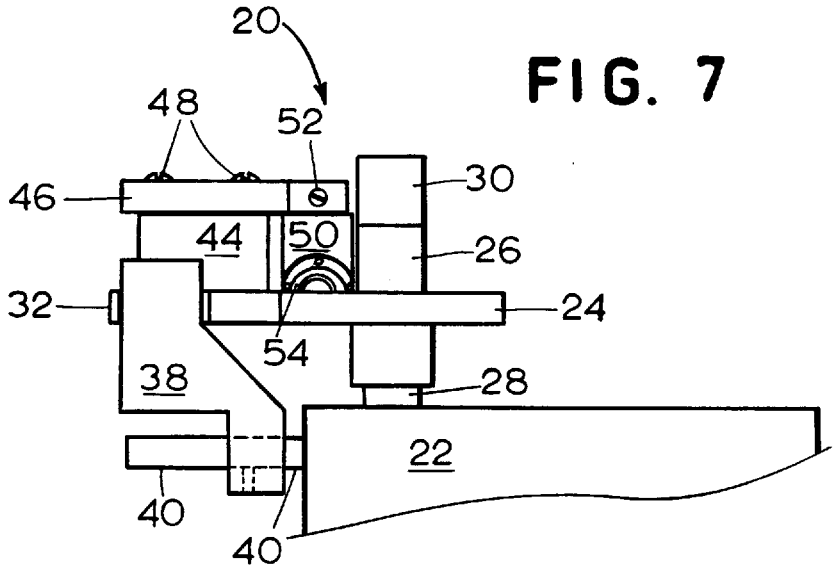
FIG. 7
FIG. 8
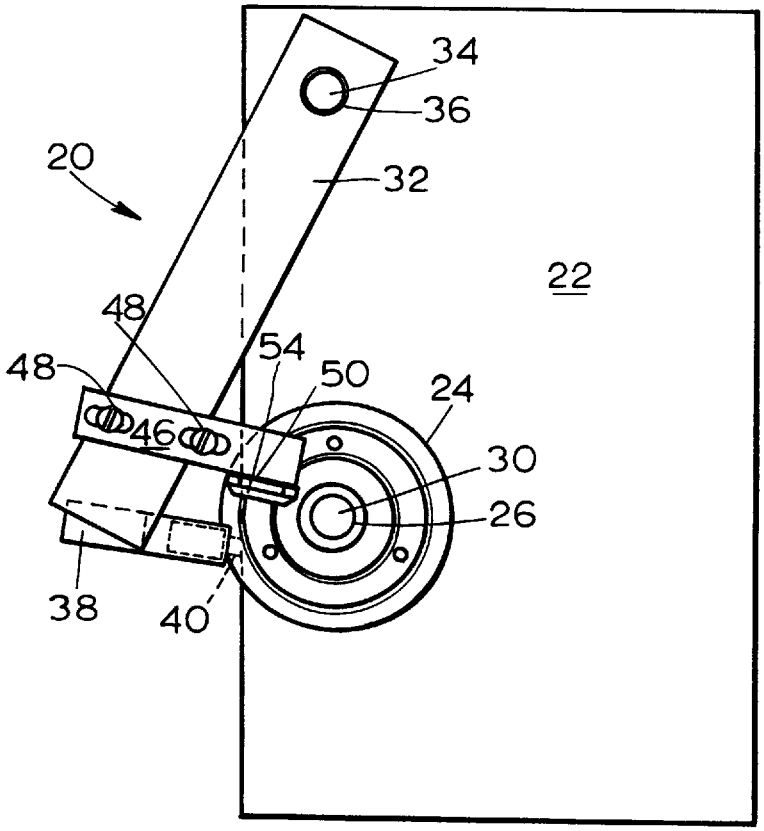

THICK FILM COATING PROCESS

This is a continuation of U.S. application Ser. No. 08/551,372, filed Nov. 1, 1995, now abandoned.

FIELD OF INVENTION

The present invention relates generally to devices for applying a coating of uniform thickness to a substrate and more particularly to devices for applying coatings to axially symmetric or circular cross-section substrates.

BACKGROUND ART

Numerous methods are known in the prior art for applying a coating to a substrate, including dip coating, spray coating, spin coating, screen printing and tape casting. Each of these methods may result in a uniform coating thickness depending on the shape of the substrate and the type of coating material applied. In some instances these methods are not useful with various types of coating materials; for example, the desired coating thickness cannot be achieved or cannot be achieved with the desired uniformity. Similarly, the shape of a particular substrate may create coating problems when one of the above methods is used.

In order to overcome some of the problems with non-uniform thickness of coating, doctor blades have been used, where the blade is moved past the substrate or the substrate is moved past the blade after coating material has been applied to the substrate. The movement of the doctor blade with respect to the substrate creates a uniform thickness of coating material on the substrate. Heretofore doctor blades have been flat, like the edge of a razor blade and are therefore limited in usefulness to substrates having flat surfaces. In addition, the doctor blade and substrate are generally moved linearly with respect to each other. Linear movement, however, is not suitable for the shapes of many types of substrates, especially those substrates with curved surfaces. Thus, a device and method for uniformly coating devices having curved surfaces, such as rods or toroids, is still needed.

SUMMARY OF THE INVENTION

In one embodiment of the present invention, a device for applying a coating of a specified thickness to a toroid-shaped substrate having a radius includes a plate for holding the toroid. The plate is rotatable about an axis and a semi-circular doctor blade is located adjacent to the plate. The blade has a radius approximately equal to the radius of the toroid plus the specified thickness of coating. The substrate passes under the doctor blade when the plate is rotated to spread the coating on the substrate.

The plate may have a ring-shaped groove for centering the toroid on the plate. The groove may have upper walls and lower walls where the upper walls are spaced from each other a distance greater than the lower walls are spaced from each other so that the substrate does not contact the upper walls when placed into the groove. The groove may have a first depth, and the plate is replaceable by a second plate where the second plate has a groove with a depth different than the depth of the groove of the plate.

The device may have an arm for suspending the doctor blade where the arm moves the doctor blade from a first position over the plate to a second position away from the plate. The doctor blade can be raised or lowered by raising or lowering the arm. The coating device may have a first axle passing through a base to rotate the plate and may have a second axle on the base for holding the arm and permitting movement from the first position to the second position. The second axle permits the raising or lowering of the arm to adjust the height of the arm and doctor blade.

The plate may be mounted on the base and the arm may have a stop which contacts the base when the doctor blade is in position over the plate for coating the substrate. The doctor blade has a front and a back where the substrate is moved from the front of the doctor blade toward the back of the doctor blade. The front of the doctor blade may be beveled.

In accordance with another aspect of the present invention, a method for applying coating material to a substrate having a circular cross-section includes placing the coating material on the first side of a substrate. A semi-circular-shaped doctor blade is set adjacent to the first side of the substrate and the coating material and substrate are passed by the doctor blade to spread a uniform thickness of coating material on the first side of the substrate.

Coating material may then be placed on a second side of the substrate and a semi-circular-shaped doctor set adjacent to the second side substrate. The coating material and substrate may be passed by the doctor blade to apply uniform thickness of coating material to the second side of the substrate. The coating material on the first side of the substrate may be hardened before coating material is placed on the second side of the substrate.

The substrate may be placed on a stand and the stand may be moved to permit the coating material and substrate to pass by the doctor blade. The coated first side of the substrate may be placed on the stand when the second side is coated. The stand may have first contact points for use in coating the first side of the substrate where the first contact points are a first distance from the doctor blade. The stand may have second contact points for use in coating the second side of the substrate where the second contact points are a second distance from the doctor blade. The second distance may be greater than the first distance to accommodate the increased thickness of the substrate after the first side has been coated.

The substrate may be a toroid and the stand may have a ring-shaped groove to hold the substrate. The stand is rotated about an axis to rotate the substrate.

In accordance with another embodiment of the present invention, a device for coating an axially symmetric substrate having a surface may include a rotatable plate for holding the substrate. A portion of the substrate extends above a top surface of the plate and a doctor blade located adjacent the plate is provided for applying the coating to the substrate. The plate rotates the substrate about its axis of symmetry so that substrate passes by the doctor blade. The surface of the substrate may have a contour and the doctor blade has a surface of a similar contour.

Other features and advantages are inherent in the coater and coating method of the present invention or will become apparent to those skilled in the art from the following detailed description in conjunction with the accompanying drawing.

BRIEF DESCRIPTION OF THE DRAWING

FIG. 7 is a front elevational view of the coating device of the present invention;

FIG. 8 is a top plan view of a coating device of the present invention;

DETAILED DESCRIPTION

Figure 1:
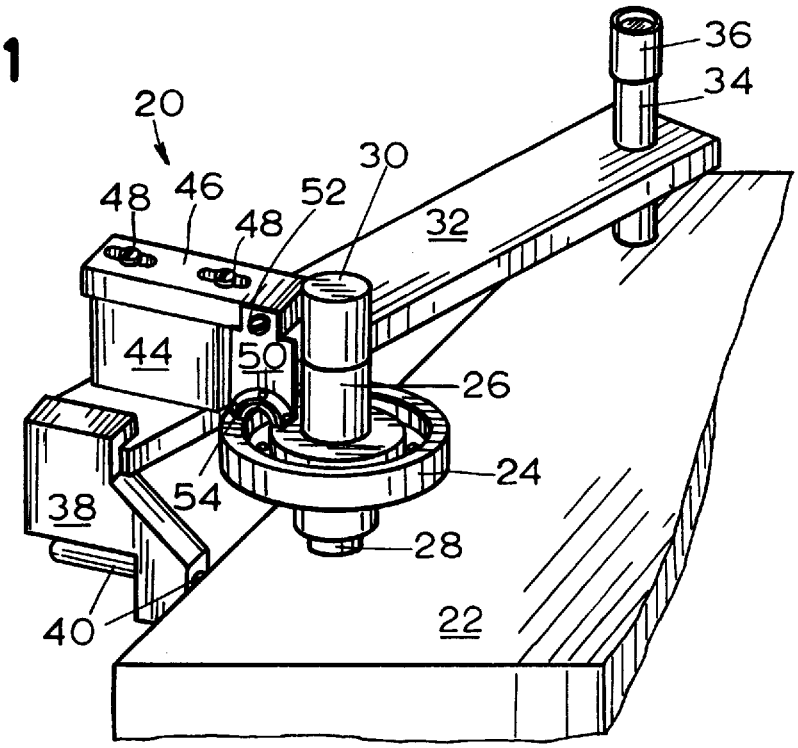
FIG. 1 is a perspective view of an embodiment of a coater of the present invention.

Referring initially to FIGS. 1, 7 and 8, a coater indicated generally at 20 has a base 22 on which is mounted a rotatable plate 24. An axle 26 is attached to the plate 24 and passes through a bearing 28 into the base 22. A motor (not depicted) may be located in the base in order to rotate the axle 26 and thereby rotate the plate 24. Other means for rotating the plate may be provided including structure for manual rotation by an operator of the coater. An adjustable knob 30 on the top of the axle 26 may be provided in order to raise or lower the plate 24 or as a means for removing the plate 24 from the axle 26.

An arm 32 is mounted to the base 22 by a post 34 which serves as an axle about which the arm 32 may pivot. The post 34 has an adjustable knob 36 which permits the arm 32 to be raised and lowered with respect to the base 22. At the end of the arm 32 is a bracket 38 which holds a stop 40. The stop 40 butts up against the side of the base 22 in order to limit rotation of the arm 32. The post 40 may be threaded (or adjustable in some other fashion) in order to change the distance between the arm 32 and the base 22 when the stop 40 is in contact with the base 22. In addition, structure may be provided, such as an elastic band (not depicted), from the arm 32 to the base 22 in order to hold the stop against the base. The adjustable knob 36 and the stop 40 (with or without an elastic band) is used to ensure proper positioning of the arm 32 with respect to the plate 24 and any substrate on the plate 24 which is to be coated. Attached to the top of the arm 32 is a block 44 on which a bar 46 is mounted by screws 48. A bracket 50 is attached to the bar 46 by a screw 52. Together, the block 44, the bar 46 and the bracket 50 mount a doctor blade 54 to the arm 32.

Figure 2:
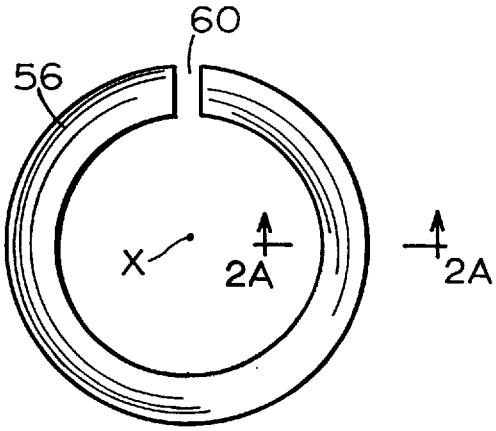
FIG. 2 is a top plan view of a toroid-shaped substrate which may be coated in accordance with the present invention.
Figure 2A:
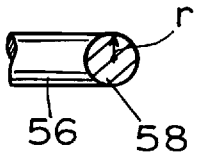
FIG. 2A is a cross-section of the substrate of FIG. 2 taken along the line 2A—2A.

Referring now to FIGS. 2 and 2A, a toroid-shaped substrate 56 has a circular cross-section 58 with a radius r. The substrate 56 has a gap 60 which may or may not be present on a substrate coated using the coater 20. Except for the gap 60 the toroid is axially symmetrical about the axis X.

Figure 3:
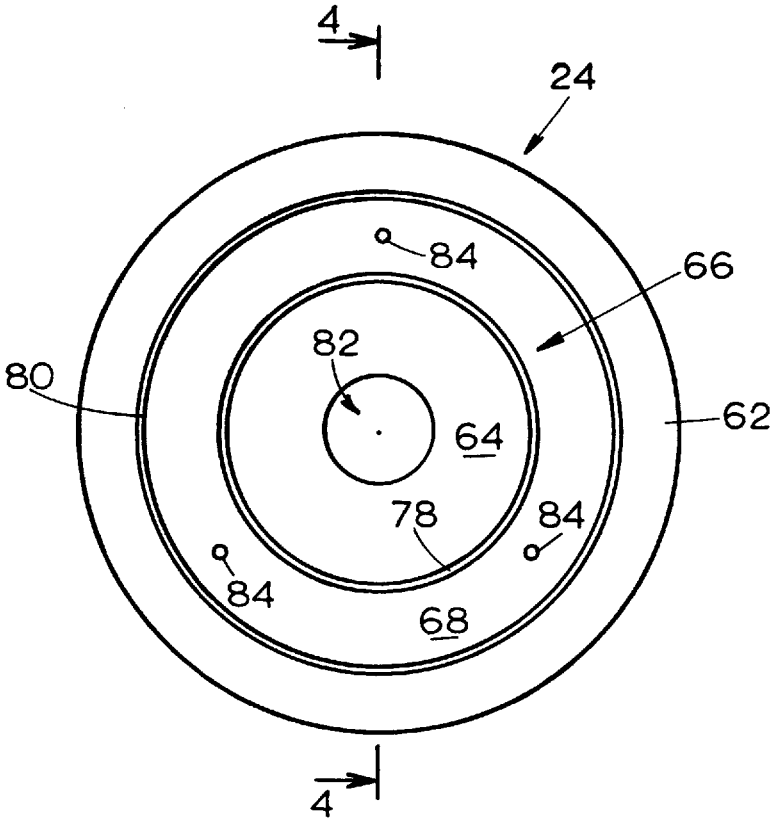
FIG. 3 is a top plan view of the rotatable plate of FIG. 1.
Figure 4:
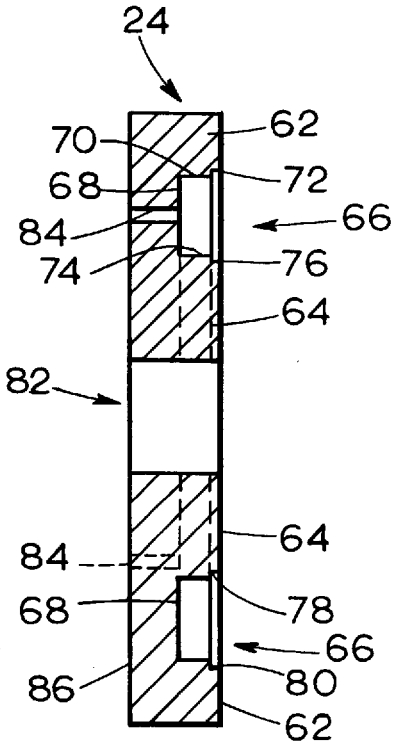
FIG. 4 is a cross-sectional view taken along the line 4—4 in FIG. 3.

Referring now to FIGS. 3 and 4, the plate 24 has an outer rim 62 and an inner rim 64 and a ring-shaped groove 66 formed between them. The groove 66 is bounded by a bottom wall 68, a lower outer wall 70, an upper outer wall 72, a lower inner wall 74, and an upper inner wall 76. The distance between the upper outer wall 72 and the upper inner wall 76 is greater than the distance between the lower outer wall 70 and lower inner wall 74 so that an inner shelf 78 and an outer shelf 80 are formed in the groove. The plate 24 has a central opening 82 for attachment of the axle 26 (shown in FIG. 1) to the plate 24. Several holes 84 extend through the bottom wall 68 of the groove 66 and out a bottom wall of the plate 86. The holes 84 are useful in dislodging a substrate from the groove 66 by inserting thin rods into the holes 84 from the back of the plate 86 to push the substrate outward. Three rods may be attached to a plate (not depicted) so that force can be applied evenly through the three holes 84 in order to dislodge the substrate 56 from the groove 66.

Figure 5:
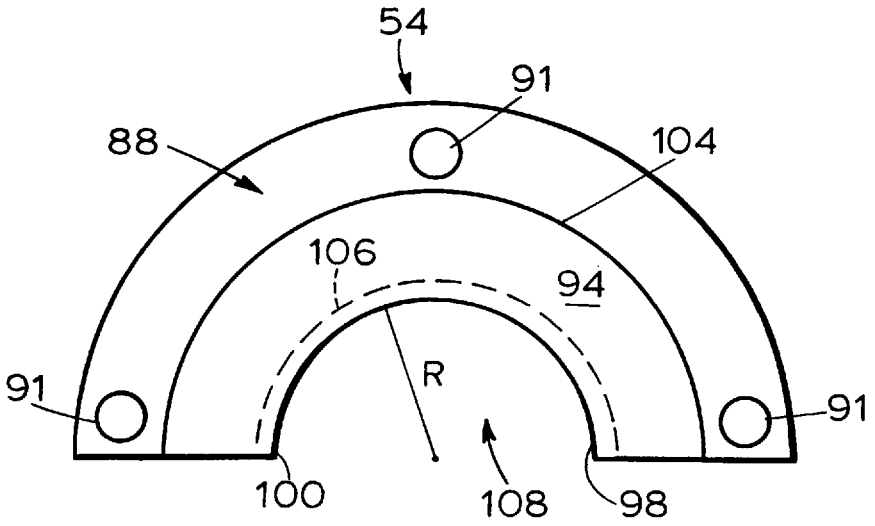
FIG. 5 is a front elevational view of a semi-circular doctor blade of the present invention.
Figure 6:
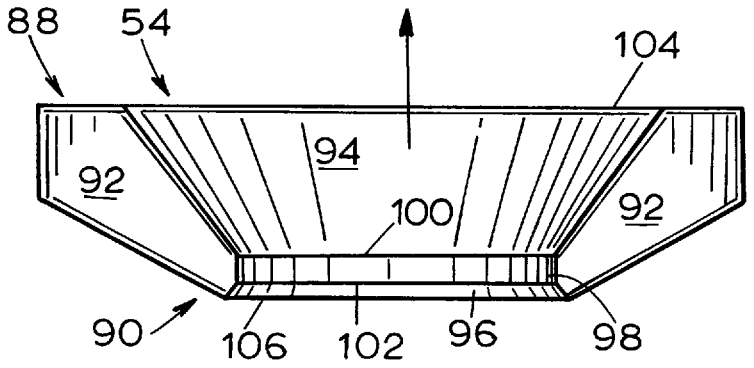
FIG. 6 is a bottom plan view of the semi-circular doctor blade of FIG. 6.

The doctor blade 54, as best seen in FIGS. 5 and 6 has a front side 90 and a backside 88. Holes 91 pass through the doctor blade 54 and are used to attach the doctor blade 54 to the bracket 50 (shown in FIG. 1). In the embodiment shown in FIG. 1, the back side 88 faces the bracket 50 and the front side 90 faces away from the bracket 50. The doctor blade 54 has sidewalls 92 which bound a rear beveled face 94, a front beveled face 96, and a semi-circular wall 98 which has a radius of curvature R. The semi-circular wall 98 is bounded on the rear face by arc 100 and bounded on the front face 90 by arc 102. The beveled wall 94 is bounded by the arc 100 and an arc 104. The front beveled wall 96 is bounded by the arc 102 and an arc 106. The doctor blade 54 is designed to have a semi-circular opening 108 (having a radius R) which is formed by the circular wall 98. As shown by the arrow in FIG. 6, a substrate with a circular cross-section passes from the front side 90 towards the rear side 88 in order to evenly apply coating material. The beveled faces 96 and the semi-circular wall 98 of the doctor blade aid in the uniform spreading of the coating material on the substrate.

Figure 9:
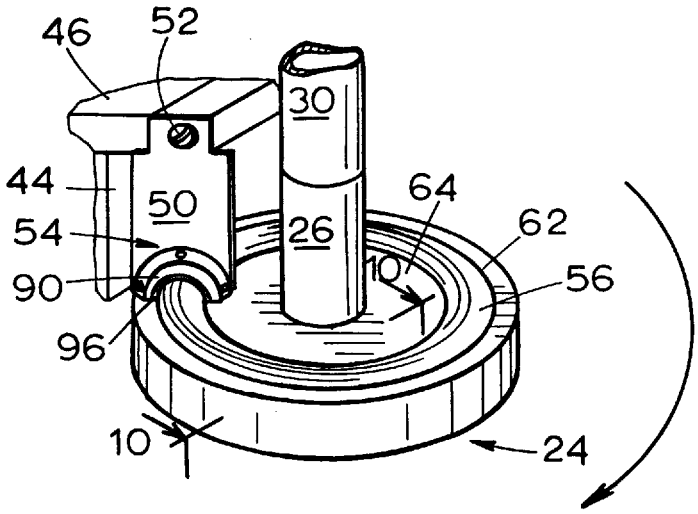
FIG. 9 is an enlarged partial perspective view of a toroid substrate and coating device of the present invention.
Figure 10A:
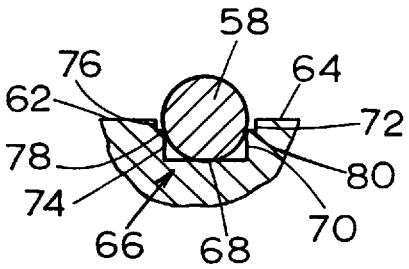
FIG. 10A is a cross-section taken along the line 10—10 of FIG. 9 showing an uncoated substrate.
Figure 10B:
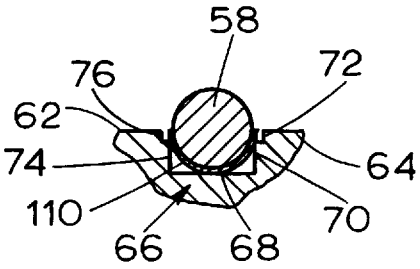
FIG. 10B is a cross-section taken along the line 10—10 of FIG. 9 showing a partially coated substrate.

Referring now to FIGS. 9, 10A, and 10B the toroid-shaped substrate 56 is placed in the groove 66 of the plate 24 for coating. As shown in FIG. 9, the plate 24 and the substrate 56 rotate clockwise in the direction of the arrow for coating. The dimensions of the walls 70, 72, 74, 76, 68, and shelves 78 and 80 of the groove 66 will be dependent on the cross-section 58 of the substrate. Upper outer side wall 72 and upper inner side wall 76 are spaced from the substrate so as not to interfere with the application of the coating material by the doctor blade 54. The side walls 92 (not depicted in FIGS. 9, 10A, and 10B) of the doctor blade 54 rest on the outer rim 62 and inner rim 64 of the plate 24 by adjusting the height of the arm 32 by use of the adjustable knob 36. Thus, only the side of the substrate 56 which is above the rim 62 and the rim 64 is adjacent the doctor blade 64 as the substrate is moved with respect to the doctor blade so that only one side of the substrate is coated at a time. Therefore, after one side has been coated the substrate must be turned upside down to coat the other side.

FIG. 10B depicts a substrate 56 which has had a coating 110 applied to one side and then has been placed in the coater 20 for coating of its other side. It may be desirable, depending on the thickness of the coating, to use one plate 24 when coating the first side of the substrate 56 and a second plate when coating the second side. Changing the plate allows the use of different size grooves 66 by, for instance, widening the base walls 68 or lengthening the lower side walls 70 and 74. By adjusting the dimensions of the walls of the groove 66 the contact points (defined as the point or points on a stand which support the substrate 56) can thereby be adjusted to accommodate the increased thickness of the substrate after a first side has been coated. Adjusting the dimensions of the groove 66 essentially adjusts the distance between the top of the plate 68 or substrate 56 and the doctor blade 54. Alternatively, the doctor blade 54 could be raised by an appropriate distance when coating one side of a substrate where the other side has already been coated.

The dimensions of the various components of the coater 20 are largely dependent on the size of the substrate 56. Of critical importance is the dimension R or radius of curvature of the doctor blade 54. R should be approximately equal to the radius r of the cross-section 58 of the toroid plus the desired thickness of the coating. The remaining dimensions of the doctor blade 54 are chosen to give the blade sufficient structural strength, or in some instances, may be determined by the type of coating material. For instance, the width of the semi-circular wall 98 (the distance from arc 100 to the arc 102) may be increased or decreased depending on the type of coating material in order to achieve a desired uniformity in the coating surface. Similarly, the angle of the bevel on the front face 94 and rear face 96 may be dependent on the type of coating material. The dimensions of the plate 24 are primarily dependent on the size of the substrate 56. In particular, the dimensions of the various walls surrounding the groove 66 should be set so as to accommodate the substrate 56 so that at least one-half of the substrate extends above the inner rim 64 and the outer rim 62. In addition, the walls around the groove 66 should be designed so that those walls provide some clearance between the substrate 56 and the walls. The dimensions of the arm 32, the bracket 38, the block 44, the bar 46 and the bracket 50 should be designed so that the doctor blade 54 is in position over the groove 66 with the semi-circular wall 98 oriented in a radial direction over the plate 24. The screws 48 and 52, the stop 40 and adjustable knob 36 may all be adjusted to properly position the doctor blade 54. In addition, a screw (not depicted) may be provided between the arm 32 and the block 44 to adjust the doctor blade 54 to ensure that it is normal to the circumference of the substrate 56.

In order to use the coater 20 of the present invention, a substrate is placed on the plate 24 and coating material is placed onto the substrate. A variety of coating types and substrates can be used and therefore a variety of methods of placing the coating material on the substrate may be chosen. For instance, the coating material may be brushed or sprayed onto the substrate or may be smeared on crudely with a blade. Coatings of a variety of desired thicknesses can be used, but the coater 20 is particularly advantageous for thick coatings. After coating material has been reasonably well applied to the substrate, the doctor blade 54 is placed adjacent the substrate. In the case of the embodiment depicted in FIG. 1, the arm 32 is rotated about its axle (post 34) in order to set the doctor blade 54 over the substrate. It may be necessary to adjust the arm 32 by using the adjustable knob 36 so that the doctor blade 54 can pass over the outer rim 62 of the plate 24 and over the substrate 56. Once the doctor blade 54 is in place, the plate 24 is rotated in order to apply the coating material evenly over one side of the substrate. Instead of rotating a plate it is possible to move a doctor blade in a circular path over a substrate. In the case where the substrate is not a toroid, rotating the plate may not be desirable. For instance, if the substrate is a rod or tube, a plate or stand and a doctor blade should be moved linearly with respect to one another. After the substrate has been coated on one side it can be removed, possibly by using the holes 84 in the plate 24.

If it is desired to coat the other side of the substrate 56, the substrate is turned upside down and placed with the coated side down on the plate 24 as is shown in FIG. 10B. Assuming that the coating material is easily deformable immediately after coating, it will be necessary to harden the coating material on the first side in some fashion prior to coating the second side. The methods chosen for hardening the coating material will be dependent on the type of coating and its thickness, but include heating the coating, blowing air over the coating, exposing the coating to various gases or simply setting the substrate aside while the coating material hardens. After the coating material has hardened sufficiently to prevent deformation, it can be placed on the plate and the other side is coated the way the first side was. If the doctor blade is truly a semi-circle i.e. having an extent of 180°, the second side will be coated in such a manner as to evenly match the coating material of the first and second sides.

If the substrate has a gap 60 and it is desired to coat the walls of that gap, coating material may be applied to the gap and then spread using a conventional straight-edged doctor blade.

In addition to the substrate 56, the doctor blade 54 is useful for coating other types of substrates with circular cross-sections such as rods or tubes. Although a different shape doctor blade would need to be used, the coater 20 with a rotatable plate 24 would also be useful for coating axially symmetric devices other than toroids with circular (or semi-circular) cross-sections. For instance, a ring-shaped substrate with a hexagonal cross-section could be coated using a three-sided doctor blade. A sphere could be coated by centering the sphere on a plate and rotating it under a semi-circular doctor blade centered on the center of the plate or under a quarter-circular doctor blade which extends from equator to pole of the sphere. To coat such structures, the doctor blade should have a contour which matches the contour of the surface of the substrate which is to be coated.

The foregoing detailed description has been given for clearness of understanding only, and no unnecessary limitations should be understood therefrom, as modifications will be obvious to those skilled in the art.

We claim:

1. A method for applying coating material to a substrate having a curved cross-section in a direction perpendicular to a first side of a substrate, the method comprising:

placing the coating material on the first side of the substrate;

placing the substrate on a stand;

setting a curved edge of a doctor blade adjacent to the first side of the substrate wherein at least one other edge of the doctor blade contacts the stand; and passing the coating material and substrate by the doctor blade to contact and spread, with the curved edge of the doctor blade, the coating material on the first side of the substrate, while the at least one other edge of the doctor blade contacts the stand.

2. The method of claim 1, further comprising:

placing the coating material on a second side of the substrate;

setting the curved edge of the doctor blade adjacent to the second side of the substrate; and passing the coating material and substrate by the doctor blade to contact and apply a uniform thickness of coating material with the curved edge of the doctor blade to the second side of the substrate while the at least one other edge of the doctor blade contacts the stand.

3. The method of claim 1, farther comprising:

after the spreading of the coating material on the first side of the substrate, hardening the coating material on the first side of the substrate;

placing the coating material on a second side of the substrate;

setting the curved edge of the doctor blade adjacent to the second side of the substrate; and passing the coating material and substrate by the doctor blade to contact and apply a uniform thickness of the coating material with the curved edge of the doctor blade to the second side of the substrate while the at least one other edge of the doctor blade contacts the stand.

4. The method of claim 3 wherein the stand is moved to permit the doctor blade to contact the coating material and permit the coating material and substrate to pass by the doctor blade.

5. The method of claim 4, wherein the coated first side of the substrate is placed on and facing the stand when the second side is coated.

6. The method of claim 5 wherein:

the stand has first contact points for contacting the substrate when coating the first side of the substrate; and the stand has second contact points different from the first contact points for contacting the coated first side of the substrate when coating the second side of the substrate.

7. The method of claim 4 wherein:

the substrate is a toroid;

the stand has a ring-shaped groove to hold the substrate; and the stand is rotated about an axis to rotate the substrate.

8. The method of claim 7 wherein:

the stand comprises a rim and a groove;

the toroid sits in the groove; and the at least one other edge of the doctor blade contacts the rim.

9. The method of claim 1 wherein:

the stand comprises a groove, an outer rim, and an inner rim;

the substrate rests in the groove; and the at least one other edge of the doctor blade contacts the outer rim of the stand and a second other edge contacts an inner rim of the stand.

* * * * *